US007140621B2

(12) United States Patent
Cheng

(10) Patent No.: US 7,140,621 B2
(45) Date of Patent: Nov. 28, 2006

(54) STEERING CONTROL MECHANISM FOR A KICK SCOOTER

(76) Inventor: Sheng-Huan Cheng, 11F, No. 212, Chung-Shan 1st Rd., Lu-Chou City, Taipei Hsien (TW)

( * ) Notice: Subject to any disclaimer, the term of this patent is extended or adjusted under 35 U.S.C. 154(b) by 259 days.

(21) Appl. No.: 10/948,508

(22) Filed: Sep. 23, 2004

(65) Prior Publication Data

US 2006/0061055 A1 Mar. 23, 2006

(51) Int. Cl.
*A63C 1/00* (2006.01)

(52) U.S. Cl. ..... 280/11.27; 280/11.28; 280/87.041

(58) Field of Classification Search ..... 280/11.27, 280/11.28, 87.041, 87.042, 87.05; D21/423, D21/425, 435, 764, 766, 765, 763
See application file for complete search history.

(56) References Cited

U.S. PATENT DOCUMENTS 4,060,253 A * 11/1977 Oldendorf ..... 280/87.042
4,838,564 A * 6/1989 Jarvis ..... 280/11.28
5,441,287 A * 8/1995 Tang ..... 280/11.28
2002/0089130 A1* 7/2002 Cassel ..... 280/11.27
2004/0140633 A1* 7/2004 Beedle et al. ..... 280/11.27

* cited by examiner

*Primary Examiner*—Christopher P. Ellis
*Assistant Examiner*—John R. Olszewski
(74) *Attorney, Agent, or Firm*—Allston L. Jones

(57) ABSTRACT

A steering control mechanism for a kick scooter includes a mounting seat connected fixedly to a front end of a footplate, a wheel seat with a fixed camming element, and an inclined rotating shaft extending through the wheel seat and connected fixedly to the mounting seat so as to allow for rotation of the wheel seat about the rotating shaft. A pressing unit is disposed slidably on the mounting seat, and is formed with a follower unit. A biasing unit biases the pressing unit to move relative to the mounting seat so as to press the follower unit of the pressing unit against the camming element of the wheel seat, thereby turning the camming element toward a central position.

6 Claims, 6 Drawing Sheets

STEERING CONTROL MECHANISM FOR A KICK SCOOTER

BACKGROUND OF THE INVENTION

1. Field of the Invention

This invention relates to a steering control mechanism, and more particularly to a steering control mechanism for a kick scooter.

2. Description of the Related Art

A conventional kick scooter is provided with a steering control mechanism for biasing a front wheel seat to return to a central position when the steering direction is changed. However, it is difficult to mount the steering control mechanism on the kick scooter.

SUMMARY OF THE INVENTION

The object of this invention is to provide a steering control mechanism for a kick scooter, which can be mounted easily on the kick scooter.

A steering control mechanism for a kick scooter includes a mounting seat connected fixedly to a front end of a footplate, a wheel seat with a fixed camming element, and an inclined rotating shaft extending through the wheel seat and connected fixedly to the mounting seat so as to allow for rotation of the wheel seat about the rotating shaft. A pressing unit is disposed slidably on the mounting seat, and is formed with a follower unit. A biasing unit biases the pressing unit to move relative to the mounting seat so as to press the follower unit of the pressing unit against the camming element of the wheel seat, thereby turning the camming element toward a central position.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
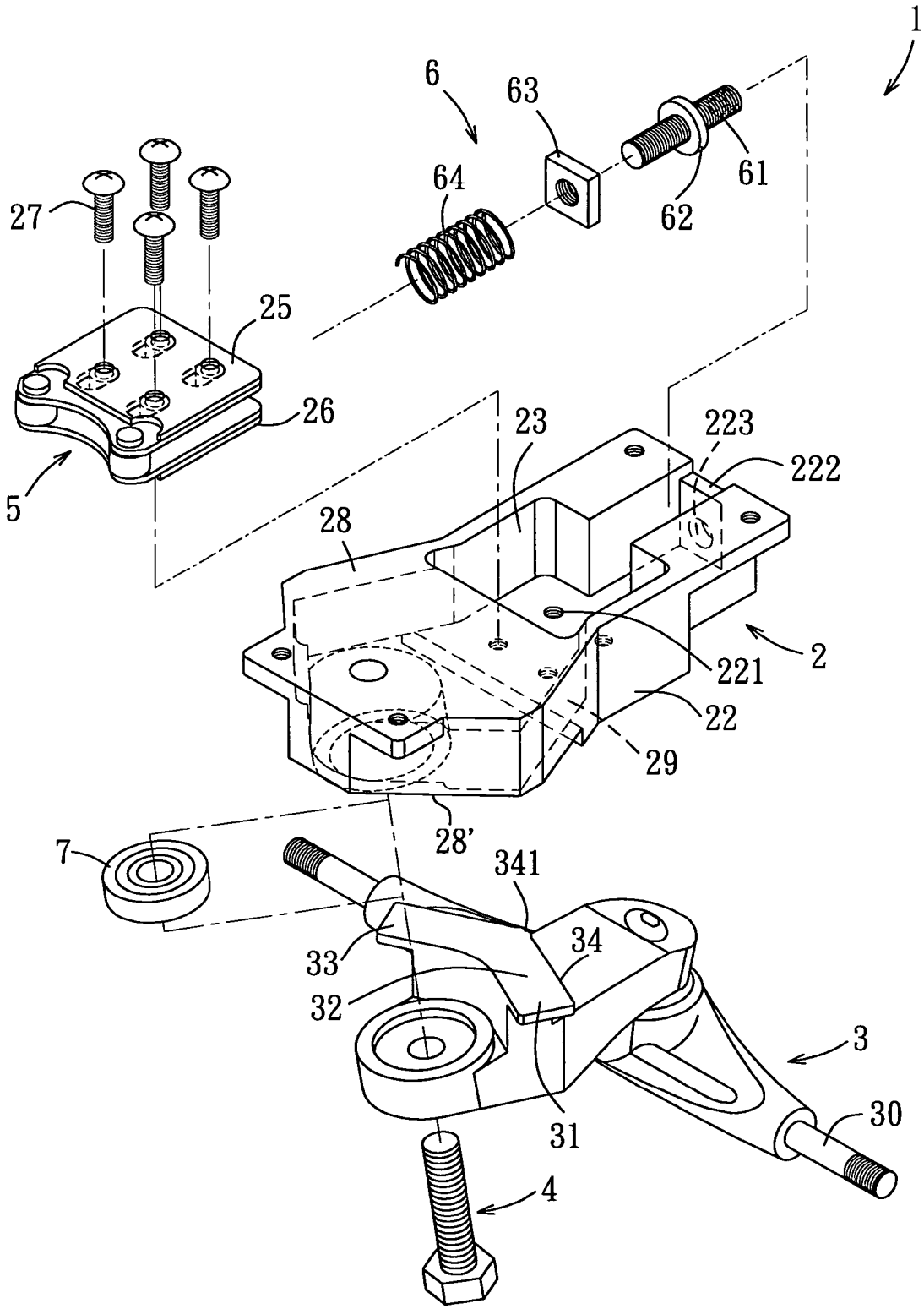
FIG. 1 is an exploded perspective view of the preferred embodiment of a steering control mechanism according to this invention.
Figure 2:
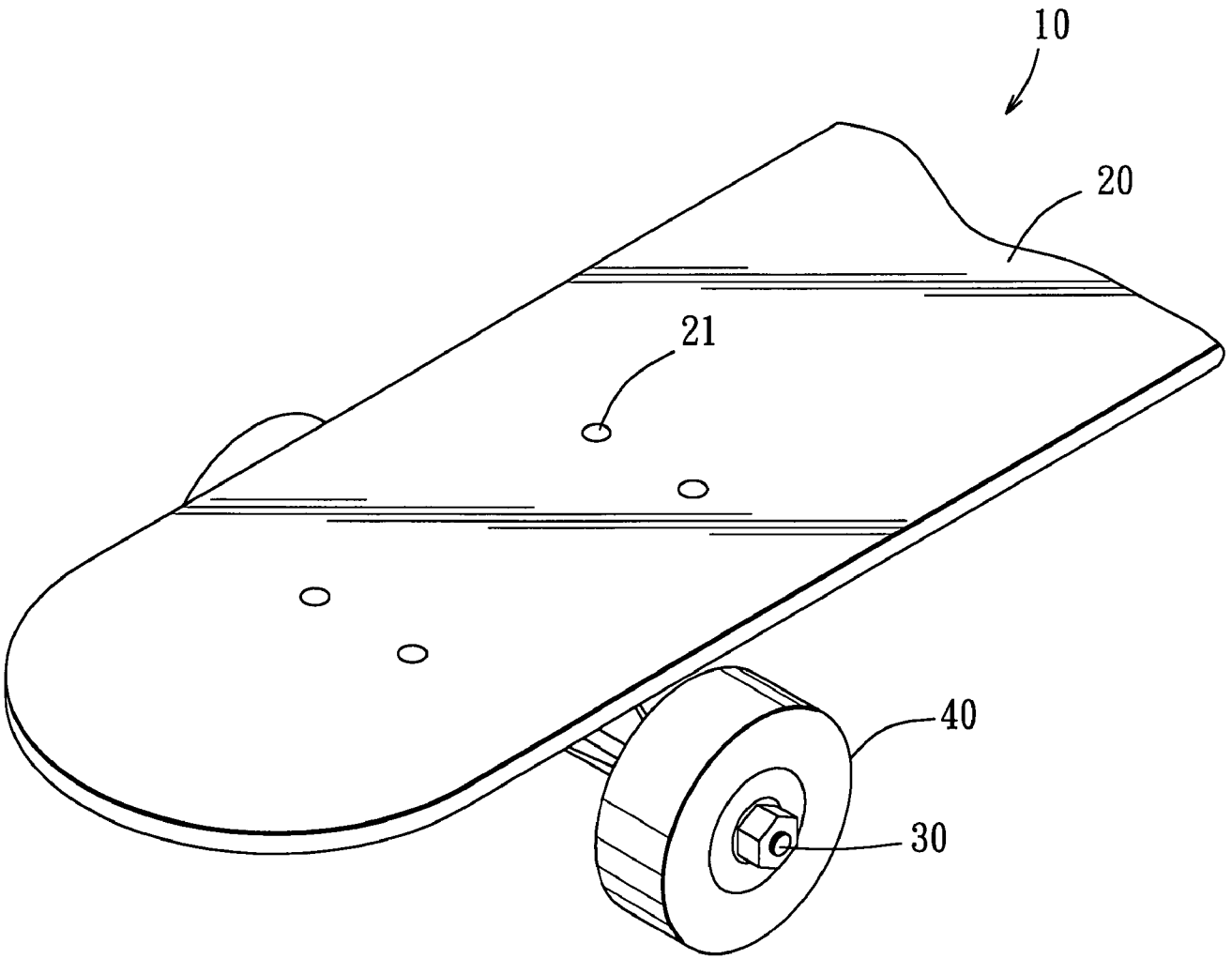
FIG. 2 is a fragmentary perspective view of a kick scooter, which incorporates the preferred embodiment.

Referring to FIGS. 1 through 5, the preferred embodiment of a steering control mechanism 1 according to this invention is used on a kick scooter 10, and includes a mounting seat 2, a wheel seat 3, an inclined rotating shaft 4, a pressing unit 5, a biasing unit 6, and a bearing 7. The scooter 10 has a footplate 20, an axle unit 30 disposed on a front end of the footplate 20, and two front wheels 40 disposed respectively on two ends of the axle unit 30.

The mounting seat 2 is connected fixedly to the front end of the footplate 20 by four lock bolts 21 (see FIG. 2), and includes a seat body 22 with a recess 23 (see FIG. 1) formed in a top surface thereof, a plurality of guide posts 24 (see FIG. 3), a pair of horizontal upper and lower clamping plates 25, 26, and a plurality of lock bolts 27. Each of the upper and lower clamping plates 25, 26 is formed with a plurality of holes 251, 261 therethrough. The guide posts 24 are configured as hollow cylinders, and have upper ends abutting against a bottom surface of the upper clamping plate 25 and communicated respectively with the holes 251 in the upper clamping plate 25, and lower ends abutting against a top surface of the lower clamping plate 26 and communicated respectively with the holes 261 in the lower clamping plate 26. Each of the lock bolts 27 extends through a respective one of the holes 251 in the upper clamping plate 25, a respective one of the guide posts 24, and a respective one of the holes 261 in the lower clamping plate 26, and engages a respective one of threaded holes 221 in the seat body 22. As such, the guide posts 24 are fixed within the recess 23.

The axle unit 30 is connected fixedly to the wheel seat 3. The wheel seat 3 is formed with a fixed camming element 31. The camming element 31 is configured as a generally V-shaped plate, and has two straight left and right plate portions 32, 33 that have rear ends formed integrally with each other. The left plate portion 32 is inclined frontwardly and leftwardly. The right plate portion 33 is inclined frontwardly and rightwardly so as to define a V-shaped rear end edge 34 that has a rear end apex 341. The mounting seat 2 has a front end portion that is formed with top and bottom walls 28, 28', which define an accommodating space 29 therebetween. The accommodating space 29 is communicated with the recess 23. The wheel seat 3 extends through the accommodating space 29.

The rotating shaft 4 extends through the wheel seat 3, is configured as a bolt, and engages a threaded hole (not shown) in the footplate 20 so as to connect the rotating shaft 4 fixedly to the mounting seat 2, thereby allowing for rotation of the wheel seat 3 about the rotating shaft 4. The bearing 7 is sleeved on the rotating shaft 4, and is disposed between the top wall 28 and the wheel seat 3.

Figure 3:
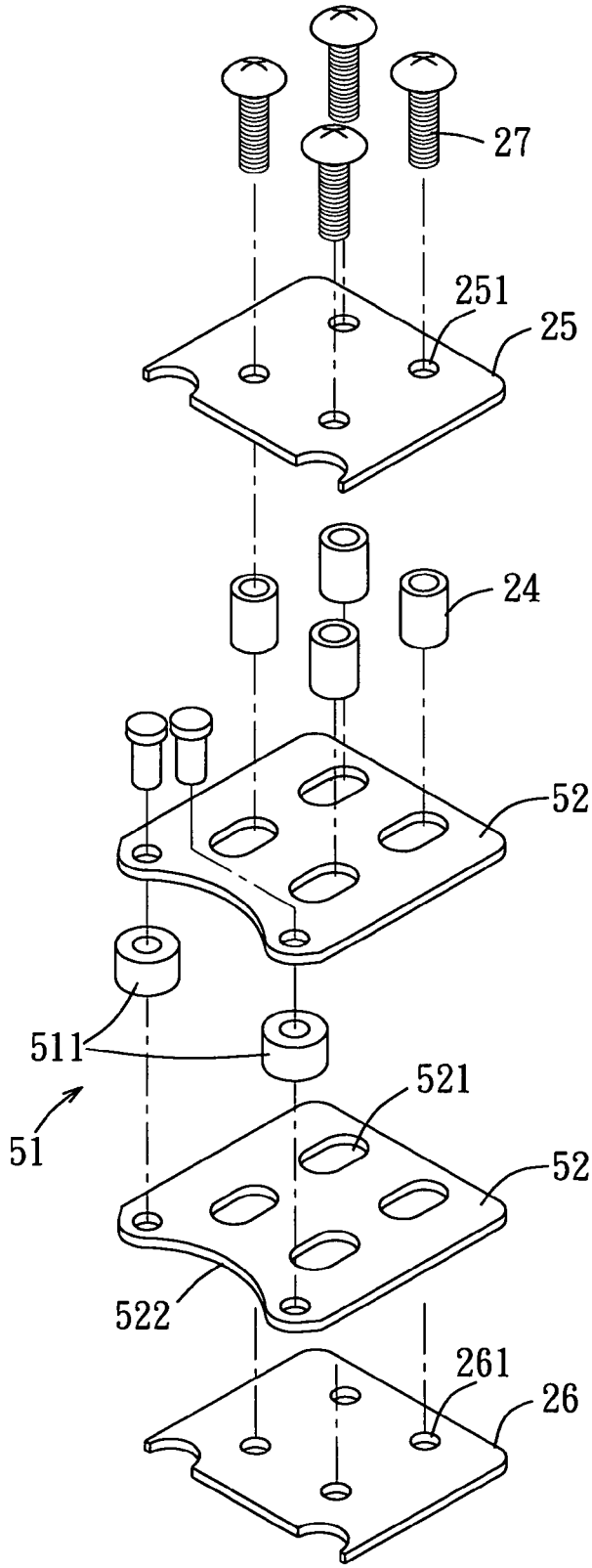
FIG. 3 is an exploded perspective view of a pressing unit and a pair of upper and lower clamping plates of the preferred embodiment.
Figure 4:
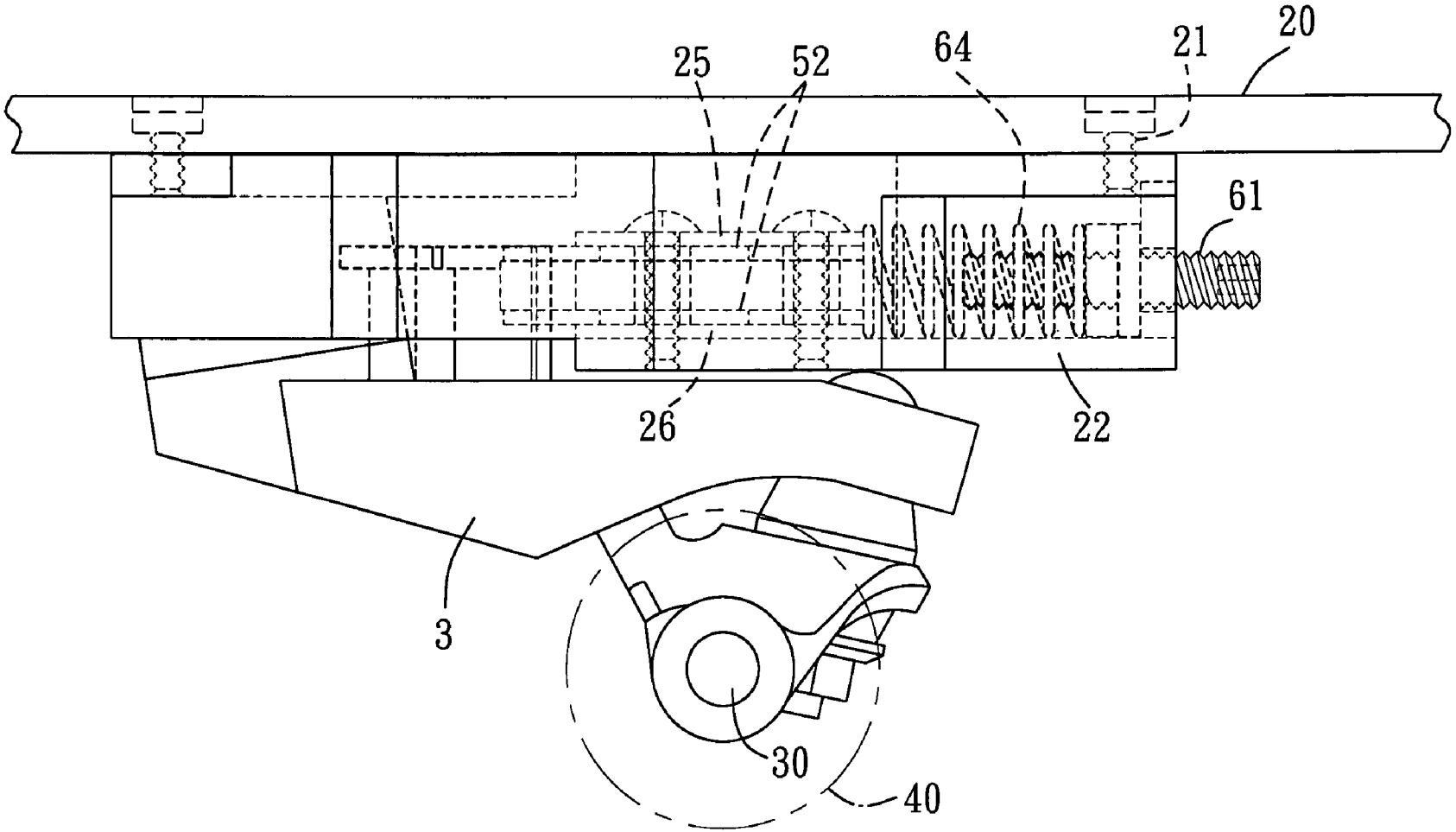
FIG. 4 is a schematic side view of the preferred embodiment.
Figure 5:
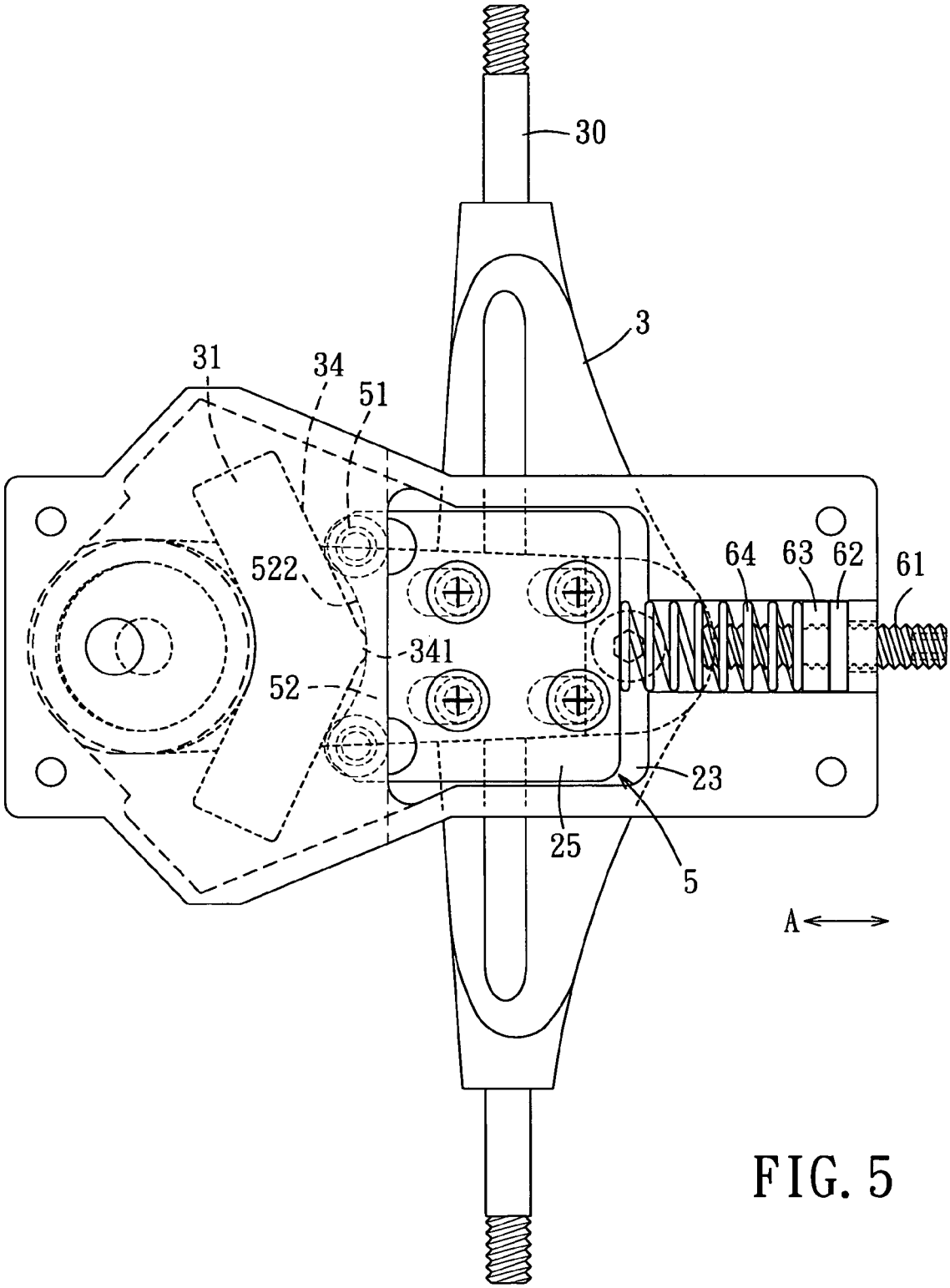
FIG. 5 is a schematic top view of the preferred embodiment, illustrating a central position of a camming element.

The pressing unit 5 is disposed slidably on the mounting seat 2, is slidable on the mounting seat 2 along a longitudinal direction (A) (see FIG. 5) of the footplate 20, and has a front end that is formed with a follower unit 51 (see FIG. 3). The follower unit 51 includes two rollers 511, each of which is rotatable about a vertical axis. The pressing unit 5 has a slide plate unit that includes two horizontal slide plates 52 disposed between and abutting respectively against the upper and lower clamping plates 25, 26. Each of the slide plates 52 is formed with a plurality of slide slots 521 and a curved front end edge 522 that is concaved rearwardly and that has left and right sides, at which the rollers 511 of the follower unit 51 are disposed respectively. The slide slots 521 in the slide plates 52 constitute a plurality of slide slot units extending along the direction (A). The guide posts 24 of the mounting seat 2 extend respectively through the slide slots 521 in each of the slide plates 52 so as to guide the pressing unit 5 to move relative to the mounting seat 2 along the direction (A).

The seat body 22 of the mounting seat 2 is formed with a fixed vertical positioning plate 222 that has a hole 223 formed therethrough and communicated with the recess 23 in the seat body 22. The biasing unit 6 includes an adjustment bolt 61, a stop ring 62, an adjustment nut 63, and a coiled compression spring 64. The adjustment bolt 61 extends through the hole 223 in the positioning plate 222.

The stop ring 62 is sleeved fixedly on an intermediate portion of the adjustment bolt 61, is disposed within the recess 23 in the seat body 22, and abuts against the positioning plate 222 so as to prevent removal of the adjustment bolt 61 from the positioning plate 222. The adjustment nut 63 engages the adjustment bolt 61 such that the stop ring 62 is located between the adjustment nut 63 and the positioning plate 222. The compression spring 64 is sleeved on the adjustment bolt 61, and is disposed between the adjustment nut 63 and the slide plates 52 of the pressing unit 5 so as to bias the slide plates 52 to move forwardly away from the adjustment nut 63 along the direction (A). As such, the pressing unit 5 can press the rollers 511 of the pressing unit 5 against the V-shaped rear end edge 34 of the camming element 31 of the wheel seat 2 so as to turn the camming element 31 toward a central position shown in FIG. 5.

Figure 6:
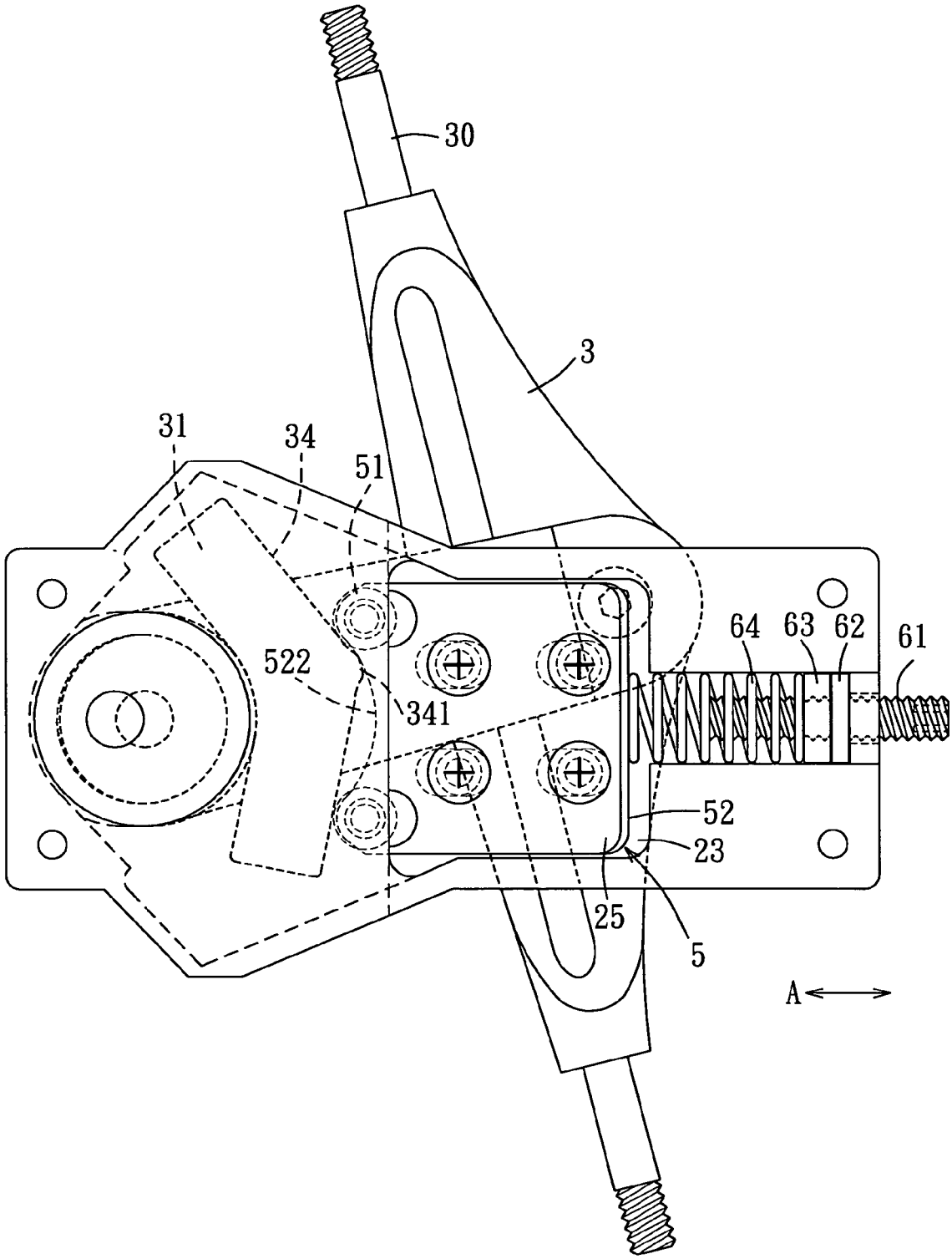
FIG. 6 is a schematic top view of the preferred embodiment, illustrating how the steering direction is changed.

Referring to FIG. 6, when the steering direction of the kick scooter 10 (see FIG. 2) is changed, the rollers 51 of the pressing unit 5 move along the V-shaped rear end edge 34 of the camming element 31, and the apex 341 of the rear end edge 34 slides along the front end edges 522 of the slide plates 52. This will cause the spring 64 to be compressed. Therefore, the spring 64 can return the camming element 31 to the central position.

With this invention thus explained, it is apparent that numerous modifications and variations can be made without departing from the scope and spirit of this invention. It is therefore intended that this invention be limited only as indicated by the appended claims.

I claim:

1. A steering control mechanism for a kick scooter, the kick scooter having a footplate, an axle unit disposed on a front end of the footplate, and two front wheels disposed respectively on two ends of the axle unit, said steering control mechanism comprising:

a mounting seat adapted to be connected fixedly to the front end of the footplate;

a wheel seat connected fixedly to said axle unit and including a fixed camming element;

an inclined rotating shaft extending through said wheel seat and connected fixedly to said mounting seat so as to allow for rotation of said wheel seat about said rotating shaft;

a pressing unit disposed slidably on said mounting seat and having a front end that is formed with a follower unit, said pressing unit being slidable on said mounting seat along a direction; and a biasing unit for biasing said pressing unit to move relative to said mounting seat along said direction so as to press said follower unit of said pressing unit against said camming element of said wheel seat, thereby turning said camming element toward a central position.

2. The steering control mechanism as claimed in claim 1, wherein said pressing unit includes a slide plate unit that is formed with a plurality of slide slot units, which extend along said direction, said mounting seat including a seat body having a top surface with a recess, and a plurality of guide posts fixed within said recess and extending respectively through said slide slot units in said slide plate unit so as to guide said pressing unit to move relative to said mounting seat along said direction.

3. The steering control mechanism as claimed in claim 2, wherein said mounting seat is formed with a fixed vertical positioning plate that has a hole formed therethrough and communicated with said recess in said seat body, said biasing unit including:

an adjustment bolt extending through said hole in said positioning plate;

a stop ring sleeved fixedly on an intermediate portion of said adjustment bolt and disposed within said recess in said seat body, said stop ring abutting against said positioning plate so as to prevent removal of said adjustment bolt from said positioning plate;

an adjustment nut engaging said adjustment bolt such that said stop ring is located between said adjustment nut and said positioning plate; and a coiled compression spring sleeved on said adjustment bolt and disposed between said adjustment nut and said slide plate unit of said pressing unit so as to bias said slide plate unit to move forwardly away from said adjustment nut.

4. The steering control mechanism as claimed in claim 2, wherein said guide posts are configured as hollow cylinders, said seat body of said mounting seat being formed with a plurality of threaded holes, said mounting seat further including:

a pair of horizontal upper and lower clamping plates, each of which is formed with a plurality of holes therethrough, said guide posts having upper ends abutting against a bottom surface of said upper clamping plate and communicated respectively with said holes in said upper clamping plate, and lower ends abutting against a top surface of said lower clamping plate and communicated respectively with said holes in said lower clamping plate; and a plurality of lock bolts, each of said lock bolts extending through a respective one of said holes in said upper clamping plate, a respective one of said guide posts, and a respective one of said holes in said lower clamping plate and engaging a respective one of said threaded holes in said seat body so as to fix said guide posts within said recess in said top surface of said seat body.

5. The steering control mechanism as claimed in claim 4, wherein said slide plate unit of said pressing unit includes two horizontal slide plates disposed between and abutting respectively against said upper and lower clamping plates, each of said slide plates being formed with a front end edge that has left and right sides, and a plurality of slide slots formed therethrough, said slide slots in said slide plates constituting said slide slot units in said slide plate unit, said follower unit of said pressing unit including two rollers that are disposed pivotally between said slide plates and that are disposed respectively at said left and right sides of each of said slide plates, each of said rollers being rotatable between said slide plates about a vertical axis.

6. The steering control mechanism as claimed in claim 5, wherein said front end edges of said slide plates are curved, and are concaved rearwardly, said camming element of said wheel seat being configured as a generally V-shaped plate that has a pair of straight left and right plate portions which have rear ends formed integrally with each other, said left plate portion being inclined frontwardly and leftwardly, said right plate portion being inclined frontwardly and rightwardly so as to define a V-shaped rear end edge for engagement with said rollers of pressing unit, said V-shaped rear end edge of said camming element having a rear end apex slidable on said front end edges of said slide plates of said pressing unit.

* * * * *